US006235442B1

(12) United States Patent
Everaars et al.

(10) Patent No.: US 6,235,442 B1
(45) Date of Patent: May 22, 2001

(54) COLORED, MAGNETICALLY ATTRACTABLE POWDER CONTAINING FLUORESCENT DYE

(75) Inventors: Marcel Dialma Everaars, Grashoek; Marcella Coppenrath, Meijel, both of (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/612,219

(22) Filed: Jul. 7, 2000

(30) Foreign Application Priority Data

Jul. 9, 1999 (NL) ..... 1012550

(51) Int. Cl.[7] ..... G03G 9/083
(52) U.S. Cl. ..... 430/106.6; 430/106
(58) Field of Search ..... 430/106, 106.6

(56) References Cited

U.S. PATENT DOCUMENTS

| | | | | |
|---|---|---|---|---|
| 4,070,577 | * | 1/1978 | Lewis et al. | 430/106 |
| 4,623,602 | * | 11/1986 | Bakker et al. | 430/106.6 |
| 4,865,937 | * | 9/1989 | Santilli et al. | 430/106 |
| 5,021,314 | * | 6/1991 | Vercoulen et al. | 430/106.6 |
| 5,330,868 | * | 7/1994 | Santilli et al. | 430/106 |
| 5,385,803 | | 1/1995 | Duff et al. | 430/138 |
| 5,554,480 | * | 9/1996 | Patel et al. | 430/106 |

FOREIGN PATENT DOCUMENTS 0350099 1/1990 (EP) .

OTHER PUBLICATIONS

Database WPI, Section Ch, Week 199018, Derwent Publictions Ltd., London, GB: Class B04 An 1990–134989, XP002132317 & JP 02 082162 A (Nissui Pharm) , 22 Maart 1990 (Mar. 22, 1990) samenvatting.

* cited by examiner

*Primary Examiner*—Mark Chapman
(74) *Attorney, Agent, or Firm*—Birch, Stewart, Kolasch & Birch, LLP

(57) ABSTRACT

A colored powder, particularly a toner powder, containing a thermoplastic resin, a fluorescent dye, possibly a magnetically attractable material and a compound of a metal of which an ion is diagmagnetic. The metal is, for example, calcium, silver, sodium, potassium, barium, aluminium, zirconium, zinc or magnesium. The metal compound is preferably a metal salt and is preferably present in the colored powder in a quantity of between 2 to 15% by weight. Advantageously, the metal compound is dissolved in the thermoplastic resin (or mixture of thermoplastic resins) or be very finely distributed therein. Metal salts, particularly zinc and magnesium salts, of aliphatic, possibly branched carboxylic acids, particularly carboxylic acids having a hydrocarbon radical with at least six carbon atoms, are preferred. The addition of the metal compound reduces extinction of the fluorescence of the fluorescent dye.

17 Claims, No Drawings

COLORED, MAGNETICALLY ATTRACTABLE POWDER CONTAINING FLUORESCENT DYE

BACKGROUND OF THE INVENTION

The present invention relates to colored powder, the individual particles of which contain a thermoplastic resin, possibly a magnetically attractable material and fluorescent dye. Powders of this kind are used, inter alia, in electrographic, electrophotographic and magnetographic image-forming processes. These types of powders, hereinafter also referred to as toner powders, are described inter alia in European Patent Application No. 0 350 099. In addition to possible other additives, toner powders according to this European Patent Application contain thermoplastic resins, finely distributed magnetically attractable pigments, such as carbonyl iron, and at least one yellow-fluorescent dye which has a strong fluorescence in the thermoplastic resin. The highly fluorescent yellow dyes are required to provide a color of acceptable brightness and color saturation to the toner powder, despite the very dark, magnetically attractable pigment present therein. In combination with the highly fluorescent yellow dye, other pigments or (fluorescent) dyes may be present to give the toner powder the intended color.

Examples of fluorescent dyes which may be present in the toner powder according to EP 0 350 099 are Rhodamine B (C.I. No. 45170), Basonyl Rot 560 (C.I., Basic Violet 11:1), Astra Phloxine (C.I. No. 48 070), Macrolex Fluorescent Yellow B10GN (C.I. Solvent Yellow 160:1), Thermoplast f-Gelb (C.I. No. 59 075) and Maxilon Brilliant Flavine 10 GFF (C.I. Basic Yellow 40).

In the preparation of toner powders according to the above European Patent Application, wherein magnetic pigment and fluorescent dye or dyes are finely distributed in the resin melt, a phenomenon which repeatedly occurs is that the fluorescence of the fluorescent dyes falls off sharply and finally colored toner powder of inadequate color quality is obtained.

This disadvantage occurs particularly in the preparation of red or magenta toner powder using the dyes of the type C.I. Basic Violet 11:1, such as Basonyl Rot 560, and fluorescence extinction is observed now and then during toner preparation in the case of other fluorescent dyes, such as the yellow-fluorescent dyes referred to in EP 0 350 099.

It has not yet been possible to ascertain the exact incidence of the fluorescence extinction, but it is clear that the effect is produced by the presence of iron ions, for example from the magnetic pigment, and that it is also influenced by the temperature level of the resin melt.

SUMMARY OF THE INVENTION

It has now surprisingly been found that the fluorescence extinction can be counteracted and even prevented by including in the toner powder a compound of a metal of which an ion is diamagnetic. Particular examples of metal of which an ion is diamagnetic include zinc and magnesium. Other metals are calcium, silver, sodium, potassium, barium, aluminium and zirconium.

By including in the resin melt a metal compound as specified above, particularly a salt of such a metal in an effective amount, e.g., about 2 to 15% by weight, during the toner preparation in a finely distributed and preferably in a dissolved condition, fluorescence extinction can be obviated or greatly reduced. Frequently a higher fluorescence can also be achieved than is possible in the case where no metal compound is present and no perceptible fluorescence extinction occurs. The choice of the metal compound, particularly the metal salt which can be used to obtain reduction of fluorescence extinction, does not appear to be critical. Thus, the fluorescence-improving effect has been observed with a considerable variation in salts of metals having a diamagnetic ion.

A particular condition for achieving better fluorescence is that the metal compound, for example, the metal salt, should be present in the resin compound in a dissolved or at least a very finely distributed form. The choice of the metal salt will accordingly be determined primarily by the solubility or its distributability in the thermoplastic resin or mixture of thermoplastic resins from which the toner powder is prepared. Of course, the metal compound (metal salt) must be selected which is colorless or practically colorless, or the color is compatible with the color to be achieved in the final toner powder. The quantity of metal compound required to avoid fluorescence extinction is present in an amount up to 15% by weight, e.g., about 2 to 15% by weight and is dependent, inter alia, on the amount of iron (e.g., iron-containing magnetic material or other iron-containing additive) present in the toner compound, the fineness with which the metal compound is distributed in the toner compound, and whether the toner compound contains substances which are chemically active with respect to the metal compound, for example, by forming a complex therewith. With increasing iron content in the toner compound and/or a less fine distribution of the metal compound, e.g., metal salt, in the toner compound, and/or if the toner compound contains substances which enter into a chemical bond (complexing) with the metal compound, a larger quantity of metal compound is required to obtain the optimum. A substance which complexes or at least can complex with zinc salts, for example, is the yellow dye (Macrolex Fluorescent Yellow 10GN (C.I. Solvent Yellow 160:1), which can be used in combination with Basonyl Rot 560 to give a red toner powder.

Examples of salts of a metal with a diamagnetic ion which can be used according to the present invention include zinc chloride, zinc sulphate, zinc nitrate, zinc iodide, zinc phosphate, zinc acetate, zinc salts of mono or polyvalent carboxylic acids such as zinc octanoate, zinc stearate, zinc palmitate, zinc-2-ethyl hexanoate, zinc malonate, zinc tartrate, zinc adipate; zinc benzoate, zinc naphthoate, and the corresponding magnesium salts. We can also mention calcium octanoate, sodium octanoate, calcium-2-ethyl hexanoate, sodium-2-ethyl hexanoate, silver stearate, silver palmitate, calcium stearate, aluminum palmitate, aluminium-2-ethyl-hexanoate, and barium-2-ethyl hexanoate.

The zinc and magnesium salts, which dissolve or are easily, very finely distributed in the resin compound from which the toner powder is formed, are preferred. Preferred salts for the resins conventionally used in toner powders, such as polyester resins, epoxy resins and phenoxy resins, are zinc and magnesium salts of branched or non-branched aliphatic carboxylic acids, and carboxylic acids particularly having a relatively long hydrocarbon radical containing at least six carbon atoms. The optimum quantity of metal compound, e.g. metal salt, for a specific toner compound of thermoplastic resin, magnetically attractable material and fluorescent dye, can readily be determined experimentally by finely distributing or dissolving different percentages by weight in a test quantity of melted or plasticized thermoplastic resin, in which the required quantities of magnetically attractable material, fluorescent dye and possibly other additives have been included either beforehand or simultaneously, and by determining the fluorescence of the samples in a known manner.

The thermoplastic resin, magnetically attractable material and fluorescent dye contained in toner powders according to the present invention may be the raw materials known for this application.

The thermoplastic resin selected is a resin in which the fluorescent dyes used have the maximum possible fluorescence. Examples of suitable thermoplastic resins are epoxy resins, polyester resins and modified polyester resins which, in their polymer chains, carry groups having a high dipole moment of preferably at least 2 debye, such as amide, anhydride, sulphonyl and/or ureido groups.

Suitable epoxy resins are the relatively low molecular weight epoxy resins such as those available under the trade name Epikote 1001 and 1004 (Shell-Nederland). Also usable are the resins derived from such epoxy resins and obtained by blocking the epoxy groups with a monofunctional reagent such as p-cumylphenol, or largely blocking them with a monofunctional reagent of this kind and for the remaining, fixing them by intermolecular reaction and/or reaction with a polyfunctional epoxy hardener. Suitable thermoplastic resins derived from epoxy resins are, for example, described in UK Patents 2 007 382, 2 014 325 and 2 036 353. These resins are considered as epoxy resins in the context of the invention.

Suitable polyester resins are linear resins derived from a dicarboxylic acid and a diol, as well as branched polyester resins obtained by polymerization of a dicarboxylic acid with a mixture of a diol and a small quantity, e.g., 5 mol %, of a more than bivalent alcohol, or by polymerization of a diol with a mixture of a dicarboxylic acid and a small quantity of a more than bivalent carboxylic acid. Suitable polyester resins are described, inter alia, in Netherlands Patent Applications 6,807,896 and 7,116,891 and European Patent Application 0 146 980. Polyester resins or modified polyester resins which, in their polymer chains, bear groups having a dipole moment higher than 2 debye can be obtained by including in the reaction mixture in a suitable quantity, e.g., 10 to 50 mol %, a bifunctional or polyfunctional reagent which bears such polar groups or which forms said groups during the polymerization reaction. For example, sulphonyl groups can be incorporated in the polymer chain by adding to the reaction mixture a sulphonyl group bearing diol as described in Netherlands Patent Application 7,116,891. Modified polyester resins which bear amide groups in their polymer chain (hereinafter referred to as polyester amides) can be obtained by the standard polycondensation techniques for the preparation of polyesters, the diol in the reaction mixture being partly replaced (e.g. 10 to 50 mol %) by a diamide or amino alcohol.

Examples of suitable diamines and amino alcohols are tetramethylene diamine, hexamethylene diamine, p-phenylene diamine, 1-amino-2-ethanol, 1-amino-2-propanol and 1-amino-3-propanol.

The usual pigments magnetizable in toner powders, such as carbonyl iron, ferrites and chromium dioxide, are used as magnetically attractable material. Depending on the color in which the toner powder is required, the toner powder contains color-imparting material in the form of yellow-fluorescent dye, possibly in combination with cyan or green dye or pigment and/or magenta or red fluorescent dye. Examples of fluorescent dyes are Maxilon Brilliant Flavine 10 GFF (C.I. Basic Yellow 40), Thermoplast f-Gelb (C.I. No. 59075) and Macrolex Fluorescent Yellow 10 GN (C.I. Solvent Yellow 160:1).

Attractive red-violet fluorescent dyes are Rhodamine B (C.I. No. 45270), Rhodamine FG (C.I. No. 45160), Basonyl rot 560 (C.I. Basic Violet 11:1), 4-cyano-cumarines, such as 3-benzothiazol-2-yl)-4-cyano-7-N,N-diethylamino cumarine and Astra Phloxine (C.I. No. 48070).

To obtain a high fluorescence of the fluorescent dye in the thermoplastic resin, the dye should be present in the dissolved state in the resin. The solubility of basic dyes in thermoplastic resins can frequently be increased by the choice of a particular salt form, such as tetrafluoroborate, perchlorate, hexafluorozirconate, p-toluene sulphonate, camphor sulphonate and dodecyl benzene sulphonate.

Because of the high fluorescence which can be obtained with it in conventional thermoplastic resins, Basonyl Rot 560 is particularly preferred as a fluorescent dye for red and magenta colored toner powders but it is precisely with this dye that the above-mentioned fluorescence extinction occurs in the most pronounced form. For that reason, the present invention will be explained with reference to formulations containing Basonyl Rot 560 as the fluorescent dye.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

EXAMPLE 1

Comparative Example

The following:

1.6% by weight Basonyl Rot 560-tetrafluoroborate

15% by weight carbonyl iron with a specific surface of 0.55 m2/g were finely distributed in polyester resin derived from propoxylated bisphenol A and adipic acid/isophthalic acid in the weight proportions of 1/3, by mixing in the resin melt.

The compound was intensively mixed at a temperature of 80° C. until the dye was completely dissolved. Different batches of the compound thus obtained were kept for 1, 3 and 5 hours at temperatures of 100° C., 110° C. and 125° C. respectively. The fluorescence level of the different batches was then determined.

The results are shown in Table 1. The Table clearly shows how the fluorescence decreases in proportion to the time that the fluorescent compound is kept at higher temperatures (circumstances which occur in the toner powder production).

TABLE 1

| | Fluorescence level | | | |
|---|---|---|---|---|
| | 80° C. | 100° C. | 110° C. | 125° C. |
| Start | 1.63 | | | |
| 1 hour | | 1.57 | 1.47 | 1.25 |
| 3 hours | | 1.50 | 1.38 | 1.17 |
| 5 hours | | 1.46 | 1.30 | 1.11 |

EXAMPLE 2

Toner resin compounds containing the polyester resin of Example 1, with 1.6% by weight of Basonyl-Rot 560 tetrafluoroborate, 15% by weight of carbonyl iron in accordance with the example and varying percentages by weight of zinc salt as indicated in Table 2, were extruded at 110° C. and for 30 minutes, 1 hour and 2 hours respectively.

The fluorescence of the different toner resin compounds was then measured.

TABLE 2

| | Zinc-2-ethyl-hexanoate | | | Zinc chloride | | | 0% zinc salt |
|---|---|---|---|---|---|---|---|
| Time | 1.6% | 4.75% | 9.5% | 1.25% | 3.75% | 7.5% | 0% |
| 30 min | 1.74 | 2.07 | 2.19 | 1.91 | 2.02 | 2.02 | 1.6 |
| 60 min | 1.85 | 2.04 | 2.23 | 1.94 | 1.94 | 1.98 | 1.48 |
| 120 min | 1.84 | 2.06 | 2.13 | 1.98 | 1.98 | 1.95 | 1.41 |

Table 2 shows that the addition of zinc salt increases the fluorescence of the toner resin compound and fluorescence extinction is practically completely obviated during the mixing of the compound at elevated temperature. Similar results to those shown in Table 2 were obtained with other zinc salts, such as zinc sulphate, zinc acetate, zinc stearate, and other thermoplastic resins. In each case, the fluorescence of the toner compound increases by the addition of the zinc compound, while the fluorescence extinction falls off during extrusion at elevated temperature.

EXAMPLE 3

Red toner powder was prepared by extruding at 110°πC. a compound consisting of:

79.7% by weight polyester resin according to Example 1

15.0% by weight carbonyl iron (HS 4849; specific surface 0.69 $m^2$)

1.0% by weight Basonyl Rot 560-perchlorate 3.6% by weight Paliogeen Rood K3580

0.7% by weight Macrolex Geel 10GN

The residence time of the compound in the extruder was about 1 hour. After extrusion and cooling, the solid compound was processed by grinding and screening to give toner powder with particle sizes between about 8 and 14 micrometers. The color values of the toner powder were:

L*:48.2; C*:60.1; h: 28.3; fluorescence: 1.26

Another red toner powder with particle sizes again between 8 and 14 micrometers was prepared in the identical manner to that described starting with a compound containing:

70% by weight polyester according to Example 1

15% by weight carbonyl iron 9.7% by weight of zinc-2-ethyl-hexanoate 3.6% by weight Paliogeen Rood K3580

1.0% by weight Basonyl Rot 560 perchlorate 0.7% by weight Macrolex Geel 10GN

The color values of this toner powder were as follows:

L*:52.5; C*:68.9; h:28.3; fluorescence: 1.54

EXAMPLE 4

The following resin compounds were prepared in the manner described in Example 3, but in this case by extruding at 100° C.

A (reference compound)

84.5% by weight polyester resin according to Example 1

1.35% by weight Basonyl Rot 560 tetrafluoroborate 14.15% by weight carbonyl iron according to Example 3

The color values of the extruded resin compound were:

L*:54.9; C*:63.6; h:333.6; fluorescence level: 1.52

B 80.9% by weight polyester resin according to Example 1

1.33% by weight Basonyl Rot tetrafluoroborate 13.87% by weight carbonyl iron according to Example 3

1.8by weight magnesium-2-ethyl-hexanoate

The color values of the extruded resin compound were:

L*:56.1; C*:64.6; h:337.3; fluorescence level: 1.72

C 80.9% by weight polyester resin according to Example 1

1.29% by weight Basonyl Rot 560 tetrafluoroborate 13.51% by weight carbonyl iron according to Example 3

4.3% by weight calcium-2-ethyl-hexanoate

The color values of the extruded resin compound were:

L*:55.2; C*:64.1; h:335.3; fluorescence level: 1.61

D

69% by weight polyester resin according to Example 1

1.1% by weight Basonyl Rot 560 tetrafluoroborate 11.52% by weight carbonyl iron according to Example 3

18.4% by weight calcium-2-ethyl-hexanoate

The color values of the extruded resin compound were:

L*:57.2; C*:65.6; h:333.6; fluorescence level: 1.76

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A colored toner powder comprising a thermoplastic resin, a magnetically attractable material, a fluorescent dye, and a metal salt containing a metal of which an ion is diamagnetic.

2. The colored toner powder according to claim 1, wherein the metal salt contains zinc or magnesium.

3. The colored toner powder according to claim 2, wherein the salt is derived from a non-branched or branched aliphatic carboxylic acid.

4. The colored toner powder according to claim 3, wherein the carboxylic acid contains a hydrocarbon radical having at least six carbon atoms.

5. The colored toner powder according to claim 4, wherein the salt is derived from 2-ethyl-hexane carboxylic acid.

6. The colored toner powder according to claim 1, wherein the salt is inorganic.

7. The colored toner powder according to claim 1 which contains up to 15% by weight of the metal salt.

8. A colored toner powder containing a thermoplastic resin, a fluorescent dye, a magnetically attractable material and a metal salt containing a metal of which an ion is diamagnetic, whereby the extinction of fluorescence of the fluorescent dye is effectively reduced.

9. The colored toner powder according to claim 8, wherein the metal salt contains zinc or magnesium.

10. The colored toner powder according to claim 9, wherein the salt is derived from a non-branched or branched aliphatic carboxylic acid.

11. The colored toner powder according to claim 10, wherein the carboxylic acid contains a hydrocarbon radical having at least six carbon atoms.

12. The colored toner powder according to claim 11, wherein the salt is derived from 2-ethyl-hexane carboxylic acid.

13. The colored toner powder according to claim 8, wherein the salt is inorganic.

14. The colored toner powder according to claim 8, which contains up to 15% by weight of the metal salt.

15. A colored powder containing a thermoplastic resin, a fluorescent dye, a magnetically attractable material and a metal salt containing a metal of which an ion is diamagnetic, whereby the extinction of fluorescence of the fluorescent dye is effectively reduced.

16. The colored powder of claim 15 containing about 2 to 15% by weight of the metal salt.

17. The colored powder of claim 15, wherein the metal salt is zinc-2-ethyl-hexanoate, calcium-2-ethyl-hexanoate or zinc chloride.

* * * * *